US006354387B1

(12) United States Patent
Harris et al.

(10) Patent No.: US 6,354,387 B1
(45) Date of Patent: Mar. 12, 2002

(54) NOZZLE ORIENTATION FOR ROLLER CONE ROCK BIT

(75) Inventors: Thomas M. Harris, Conroe; Leroy W. Ledgerwood, III, Cypress; Brian C. Wiesner; Sean K. Berzas, both of The Woodlands; Brian A. Baker, Spring, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/496,012

(22) Filed: Feb. 1, 2000

Related U.S. Application Data

(60) Provisional application No. 60/121,982, filed on Feb. 25, 1999.

(51) Int. Cl.[7] ..... E21B 10/18

(52) U.S. Cl. ..... 175/340; 175/424

(58) Field of Search ..... 175/340, 339, 175/424

(56) References Cited

U.S. PATENT DOCUMENTS

| | | | | | |
|---|---|---|---|---|---|
| 2,318,370 | A | | 5/1943 | Burch | 255/71 |
| 2,901,223 | A | | 8/1959 | Scott | 255/302 |
| 3,014,544 | A | * | 12/1961 | Steen | 175/340 |
| 3,070,182 | A | | 12/1962 | Runte | |
| 3,137,354 | A | | 6/1964 | Crawford et al. | |
| 3,195,660 | A | | 7/1965 | McKown | 175/65 |
| 4,174,759 | A | | 11/1979 | Arbuckle | |
| 4,189,014 | A | | 2/1980 | Allen et al. | 175/339 |
| 4,222,447 | A | * | 9/1980 | Cholet | 175/340 |
| 4,372,399 | A | | 2/1983 | Cork | |
| 4,516,642 | A | | 5/1985 | Childers et al. | |
| 4,546,837 | A | | 10/1985 | Childers et al. | |
| 4,558,754 | A | | 12/1985 | Childers et al. | |
| 4,582,149 | A | | 4/1986 | Slaughter, Jr. | |
| 4,611,673 | A | | 9/1986 | Childers et al. | |
| 4,665,999 | A | * | 5/1987 | Shoemaker | 175/340 |
| 4,741,406 | A | | 5/1988 | Deane et al. | |
| 4,775,412 | A | | 10/1988 | Thompson | |
| 4,794,995 | A | | 1/1989 | Matson et al. | |
| 4,848,476 | A | | 7/1989 | Deane et al. | |
| 4,940,099 | A | * | 7/1990 | Deane et al. | 175/374 |
| 4,989,680 | A | | 2/1991 | Deane et al. | |
| 5,096,005 | A | | 3/1992 | Ivie et al. | |
| 5,579,855 | A | | 12/1996 | Dickey | |
| 5,601,153 | A | | 2/1997 | Ensminger et al. | |
| 6,098,728 | A | * | 8/2000 | Wells et al. | 175/340 |
| 6,142,247 | A | * | 11/2000 | Pessier | 175/340 |

OTHER PUBLICATIONS

SPE 14220; Development, Laboratory, and Field Test Results of a New Hydraulic Design for Roller Cone Rock Bits; R.H. Slaughter Jr.; 1985.

(List continued on next page.)

*Primary Examiner*—Hoang Dang
(74) *Attorney, Agent, or Firm*—Bracewell & Patterson, L.L.P.

(57) ABSTRACT

A tri-cone earth-boring bit has nozzles oriented for improved cone cleaning, bottom cleaning and cuttings evacuation. Each of the nozzles is oriented to discharge across a trailing side of a cone at a point considerably inboard of the borehole wall. Each nozzle has an outlet located radially outward from the bit axis a distance that is at least equal to a distance from a top dead center of the heel row of each of the cones to the bit axis. Also, each of the nozzles is oriented to discharge drilling fluid along a line that contacts the borehole bottom at a distance that is no greater than a distance from a bottom dead center of an outermost of the inner rows of the cone to the bit axis. A portion of the drilling fluid discharged from each nozzle will pass by more than one of the rows of the cones.

26 Claims, 4 Drawing Sheets

OTHER PUBLICATIONS

SPE/IADC 18630; Performance Comparison of Rolling Cutter Bits with Alternate Nozzle Configurations; S.R. Moffitt & D.Y. McGehee; 1989.

IADC/SPE 23871; New Roller Cone Bits with Unique Nozzle Designs Reduce Drilling Costs; S.R. Moffitt, D.E. Pearce & C.R. Ivie; 1992.

Unpublished; Variations in Nozzle Positioning Maximizes Roller Cone ROP in Different Shales; C.S. Charles, R.C. Pessier, L.W. Ledgerwood III; 1998.

IADC/SPE 59111; Advanced Hydraulics Analysis optimizes Performance of Roller Cone Drill Bits; L.W. Ledgerwood, M.R. Wells, T.M. Harris; 2000.

* cited by examiner

NOZZLE ORIENTATION FOR ROLLER CONE ROCK BIT

This application claims the benefit of provisional patent application Ser. No. 60/121,982, filed Feb. 25, 1999.

TECHNICAL FIELD

This invention relates to earth boring bits used in the oil, gas and mining industries, especially those having nozzle arrangements to prevent the cone teeth from "balling-up" with compacted cuttings from the earth.

BACKGROUND ART

Howard R. Hughes invented a drill bit with rolling cones used for drilling oil and gas wells, calling it a "rock bit" because it drilled from the outset with astonishing ease through the hard cap rock that overlaid the producing formation in the Spindletop Field near Beaumont, Tex. His bit was an instant success, said by some the most important invention that made rotary drilling for oil and gas commercially feasible the world over (U.S. Pat. No. 930,759, "Drill", Aug. 10, 1909). More than any other, this invention transformed the economies of Texas and the United States into energy producing giants. But his invention was not perfect.

While Mr. Hughes' bit demolished rock with impressive speed, it struggled in the soft formations such as the shales around Beaumont and in the Gulf Coast of the United States. Shale cuttings sometimes compacted between the teeth of the "Hughes" bit, until it could no longer penetrate the earth. When pulled to the surface, the bit was often, as the drillers said, "balled up" with shale—sometimes until the cones could no longer turn. Even moderate balling-up slowed the drilling rate and caused generations of concern within Hughes' and his competitors' engineering organizations.

Creative and laborious efforts ensued for decades to solve the problem of bits "balling-up" in the softer formations, as reflected in the prior art patents. Impressive improvements resulted, including a bit with interfitting or intermeshing teeth in which circumferential rows of teeth on one cone rotate through opposed circumferential grooves, and between rows of teeth, on another cone. It provided open spaces on both sides of the inner row teeth and on the inside of the heel teeth. Material generated between the teeth was displaced into the open grooves, which were cleaned by the intermeshing rows of teeth. It was said, and demonstrated during drilling, " . . . the teeth will act to clear each other of adhering material." (Scott, U.S. Pat. No. 1,480,014, "Self-Cleaning Roller Drill", Jan. 8, 1924.) This invention led to a two cone bit made by " . . . cutting the teeth in circumferential rows spaced widely apart . . . " This bit included " . . . a series of long sharp chisels which do not dull for long periods." The cones were true rolling cones with intermeshing rows of teeth, and one cone lacked a heel row. The self cleaning effect of intermeshing thus extended across the entire bit, a feature that would resist the tendency of the teeth becoming balled-up in soft formations. (Scott, U.S. Pat. No. 1,647,753, "Drill Cone", Nov. 1, 1927.)

Interfitting teeth are shown for the first time on a three cone bit in U.S. Pat. No. 1,983,316. The most significant improvement was the width of the grooves between teeth, which were twice as wide as those on the two cone structure without increasing uncut bottom. This design also combines narrow interfitting inner row teeth with wide non-interfitting heel rows.

A further improvement in the design is shown in U.S. Pat. No. 2,333,746, in which the longest heel teeth were partially deleted, a feature that decreased balling and enhanced penetration rate. A refinement of the design was the replacement of the narrow inner teeth with fewer wide teeth, which again improved performance in shale drilling.

By now the basic design of the three cone bit was set: (1) All cones had intermeshing inner rows, (2) one cone had a heel row and a wide space or groove equivalent to the width of two rows between it and the first inner row with intermeshing teeth to keep it clean, (3) another cone had a heel row and a narrow space or groove equivalent to the width of a single row between it and the first inner row without intermeshing teeth, and (4) a third cone had a heel and first inner row in a closely spaced, staggered arrangement. A shortcoming of this design is the fact that it still leaves a relatively large portion of the cutting structure out of intermesh and subject to balling.

Another technique of cleaning the teeth of cuttings involved flushing drilling fluid or mud directly against the cones and teeth from nozzles in the bit body. Attention focused on the best pattern of nozzles and the direction of impingement of fluid against the teeth. Here, divergent views appeared, one inventor wanting fluid from the nozzles to " . . . discharge in a direction approximately parallel with the taper of the cone" (Sherman, U.S. Pat. No. 2,104,823, "Cone Flushing Device", Jan. 11, 1938), while another wanted drilling fluid discharged " . . . approximately perpendicular to the base [heel] teeth of the cone." (Payne, U.S. Pat. No. 2,192,693, "Wash Pipe", Mar. 5, 1940.)

A development concluded after World War II seemed for a while to solve completely the old and recurrent problem of bit balling. A joint research effort of Humble Oil and Refining Company and Hughes Tool Company resulted in the "jet" bit. This bit was designed for use with high pressure pumps and bits with nozzles (or jets) that pointed high velocity drilling fluid between the cones and directly against the borehole bottom, with energy seemingly sufficient to quickly disperse shale cuttings, and simultaneously, keep the cones from balling-up because of the resulting highly turbulent flow condition between the cones. This development not only contributed to the reduction of bit balling, but also addressed another important phenomenon which become later known as chip holddown.

From almost the beginning, Hughes and his engineers recognized variances between the drilling phenomena experienced under atmospheric condition and those encountered deep in the earth. Rock at the bottom of a borehole is much more difficult to drill than the same rock brought to the surface of the earth. Model sized drilling simulators showed in the 1950's that removal of cuttings from the borehole bottom is impeded by the formation of a filter cake on the borehole bottom. "Laboratory Study Of Effect Of Overburden, Formation And Mud Column Pressures On Drilling Rate Of Permeable Formation", R. A. Cunningham and J. G. Eenick, presented at the 33rd Annual Fall Meeting of the SPE, Houston, Tex., Oct. 5–8, 1958. While a filter cake formed from drilling mud is beneficial and essential in preventing sloughing of the wall of the hole, it also reduces drilling efficiencies. If there is a large difference between the borehole and formation pressure, also known as overbalance or differential pressure, this layer of mud mixes cuttings and fines from the bottom and forms a strong mesh-like layer between the cone and the formation, which keeps the cone teeth from reaching virgin rock. The problem is accentuated in deeper holes since both the mud weights and hydrostatic pressure are inherently higher. One approach to overcome this perplexing problem is the use of ever higher jet velocities in an attempt to blast through the filter cake and dislodge cuttings so they may be flushed through the well bore to the surface.

The filter cake problem and the bit balling problem are distinct since filter cake build up, also known as bottom balling, occurs mainly at greater depth with weighted muds, while cutting structure balling is more typical at shallow depths in more highly reactive shales. Yet, these problems can overlap in the same well since various formations and long distances must be drilled by the same bit. Inventors have not always made clear which of these problems they are addressing, at least not in their patents. However, a successful jet arrangement must deal with both problems; it must clean the cones but also impinge on bottom to overcome bottom balling.

The direction of the jet stream and the area of impact on the cones and borehole bottom receive periodic attention of inventors. Some interesting, if unsuccessful, approaches are disclosed in the patents. One patent provides a bit that discharges a tangential jet that sweeps into the bottom corner of the hole, follows a radial jet, and includes an upwardly directed jet to better sweep cuttings up the borehole. (Williams, Jr., U.S. Pat. No. 3,144,087, "Drill Bit With Tangential Jet", Aug. 11, 1964). The cones have unusual cone arrangement, including one with no heel row of teeth, and two of the cones do not engage the wall of the borehole. One nozzle extends through the center of the cone and bearing shaft and another exits at the bottom of the "leg" of the bit body, near the corner of the borehole.

There is some advantage to placing the nozzles as close as possible to the bottom of the borehole. (Feenstra, U.S. Pat. No. 3,363,706, "Bit With Extended Jet Nozzles", Jan. 16, 1968). The prior art also shows examples of efforts to orient the jet stream from the nozzles such that they partially or tangentially strike the cones and then the borehole bottom at an angle ahead of the cones. (Childers, et al, U.S. Pat. No. 4,516,642, "Drill Bit Having Angled Nozzles For Improved Bit and Well Bore Cleaning", May 14, 1985.)

A more recent approach to the problem of bit balling is disclosed in the patent to Isbell and Pessier, U.S. Pat. No. 4,984,643, "Anti-Balling Earth Boring Bit", Jan. 15, 1991. Here, a nozzle directs a jet stream of drilling fluid with a high velocity core past the cone and inserts of adjacent cones to the borehole bottom to break up the filter cake, while a lower velocity skirt strikes the material packed between the inserts of adjacent cones. The high velocity core passes equidistant between a pair of cones, and the fluid within the skirt engages each cone in equal amounts. While significant improvement was noted in reducing bit and bottom balling, the problem persists under some drilling conditions.

In spite of the extensive efforts of inventors laboring in the rock bit art since 1909, including those of the earliest, Howard R. Hughes, the ancient problem of rock bits "balling-up" persists. The solutions of the past prevent balling in many drilling environments, and the bit that balls up so badly that the cones will no longer turn is a species of the problem that has all but completely disappeared. Now, the problem is much more subtle and often escapes detection. Often, it occurs only in the downhole environment and thus is largely unappreciated as a cause of poor drilling performance in the field. Simulation has allowed duplication of that environment and thus led to substantial refinements and improvements of earlier designs.

SUMMARY OF INVENTION

In this invention, a bit is provided with nozzles positioned and oriented in a manner that achieves superior rates of penetration to prior art types. At least one of the nozzles has an outlet located radially outward from the bit axis a distance that is at least equal to a distance from the top dead center of the heel row of each of the cones to the bit axis. The top dead center of the heel row is the uppermost point that a heel row cutting element will reach as it rotates around the bearing pin.

Also, the nozzle is oriented to discharge drilling fluid onto the borehole bottom at a contact point significantly inward from the sidewall of the borehole. The contact point is located at a distance from the bit axis that is no greater than a distance from a bottom dead center of the heel row to the bit axis. Preferably the contact point distance is no greater than a distance from the bit axis to a farthest outermost of any of the inner cutting elements of all the cones. The farthest outermost inner cutting element is one that is not in a heel row, but is the head row or farthest from the bit axis of all of the inner cutting elements of all of the cones. Bottom dead center is the lowest point that the heel row or farthest outermost inner cutting element will reach as it rotates around the bearing pin. Furthermore, the contact point distance for the nozzle discharge is preferably less than 85 percent of the bit radius, and in the preferred embodiment in the range from 55 to 80 percent of the bit radius.

The nozzle discharges along a projected cylindrical core that is substantially tangent to the trailing side of the surface of the associated cone, the associated cone being the cone closest to a particular nozzle. Preferably, the projected cylindrical core passes obliquely between the heel row and the outermost inner row along a trailing side of one of the cones.

When oriented in this manner, a portion of the drilling fluid discharged from the nozzles will flow past more than one of the rows of each of the cones. This enhances cleaning of the cone. Also, it improves bottom cleaning as well as cuttings evacuation.

BEST MODE FOR CARRYING OUT THE INVENTION

Figure 1:
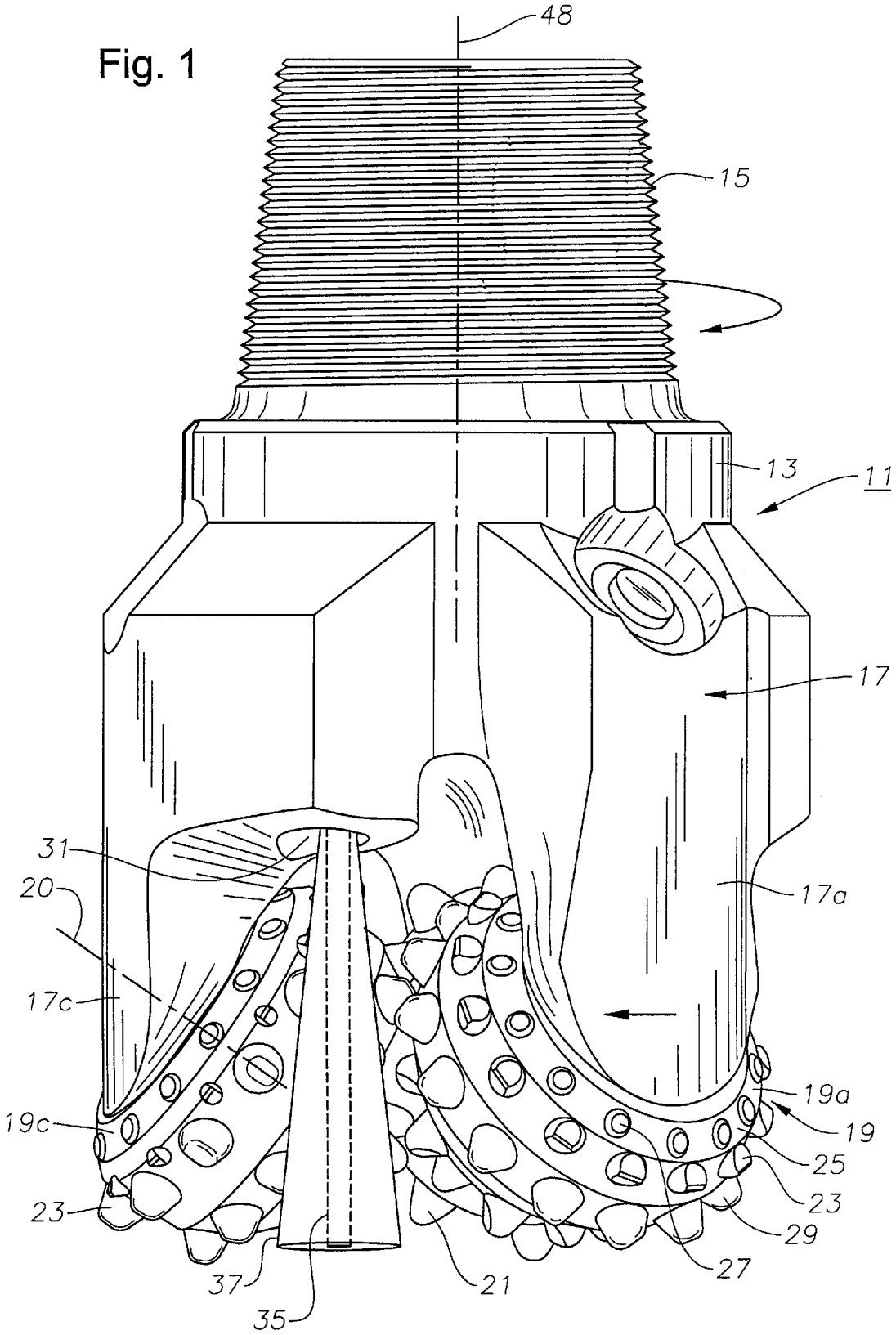
FIG. 1 is a side elevational view of an earth-boring bit constructed in accordance with this invention, schematically showing a discharge of drilling fluid out one of the nozzles.

Referring to FIG. 1, bit 11 is an earth boring bit having a body 13. A threaded pin 15 extends upward from body 13 for securing to a drill string. Body 13 is formed of three "thirds" or sections welded together, the sections having bit legs 17*a*, 17*b* and 17*c* as shown also in FIG. 2. Each bit leg 17 has a depending bearing pin (not shown) that rotatably receives a generally conical cone 19. Cone 19*a* is mounted to bit leg 17*a*, cone 19*b* to bit leg 17*b*, and cone 19*c* to bit leg 17*c*. As shown in FIG. 1, cone 19*c* rotates on the bearing pin of bit leg 17*c* about a cone axis 20.

Figure 2:
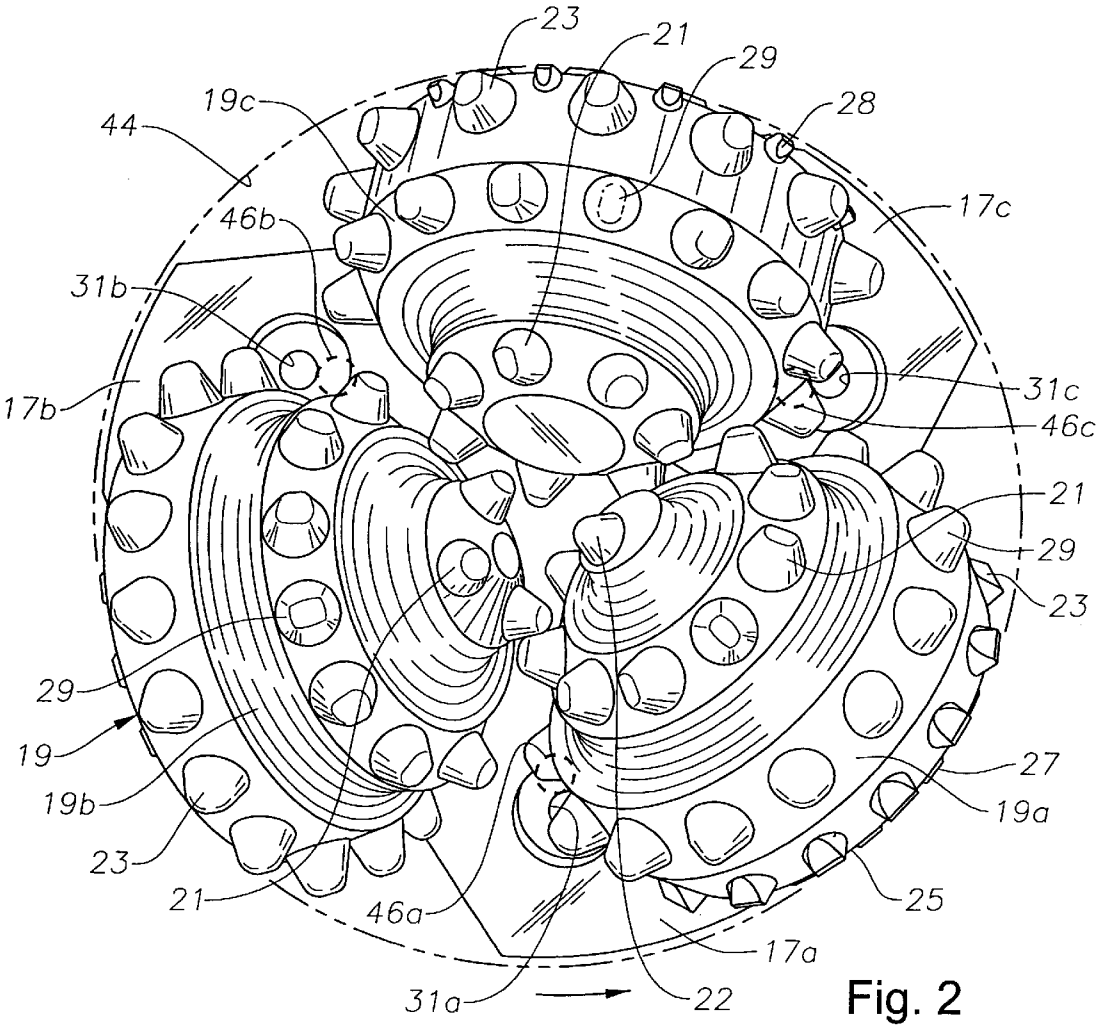
FIG. 2 is a bottom view of the earth-boring bit of FIG. 1.

As shown also in FIG. 2, an innermost inner row 21 of cutting elements is near the apex or nose of each cone 19, which in the embodiment shown comprises tungsten carbide inserts interferingly pressed into mating holes. The word "row" as used herein means that at least two of the cutting elements on a cone 19 will be at the same distance from an axis 48 (FIG. 4) of rotation of bit 11 when at bottom dead center, even if those two are not located next to each other. Rather than tungsten carbide elements, cones 19 may have cutting elements of milled teeth machined from the body of each cone 19. Cone 19*a* also has a cutting element 22 located directly on the nose.

Each cone 19 also has a heel row 23 located next to a gage surface 25. The cutting elements of the heel row 23 serve to cut the borehole corner or sidewall, and have outermost portion located at or fairly close to the gage diameter of the bit. In the embodiment shown, the cutting elements in heel row 23 on cone 19*a* are chisel-shaped, with crests parallel to the direction of cone rotation. Heel rows 23 of cones 19*b* and 19*c* are larger and have their crests perpendicular to the direction of cone rotation. A plurality of flat wear resistant compacts 27 are located on gage surface 25. On cone 19*c*, trimmer inserts 28 may be located at the junction between the cone surface at heel row 23 and gage surface 25, spaced between the inserts of heel row 23. Trimmer inserts 28 are smaller tungsten carbide elements than the cutting elements of heel row 23 located slightly farther outward than heel row cutting elements 23. Although trimmer inserts 28 may cut portions of a borehole sidewall, they are not considered heel row inserts for the purposes herein. Many variations of cutting element configurations and spacing are possible.

In addition to the innermost inner row 21, each cone 19 has an outermost inner row 29 located next to heel row 23. Although not shown, a cone may also have additional inner rows spaced between outermost inner row 29 and innermost inner row 21. Typically, the distance from the bit axis 48 (FIG. 4) to the outermost inner row 29 of each cone 19 differs. One of the outermost inner rows 29 will be farther outward than the outermost inner rows 29 of the other cones 19, and will be referred to herein as the farthest outermost inner row. Normally, the heel row cutting elements 23 are all located the same distance from the bit axis 48. This results in a different distance or spacing between rows 23, 29 for the different cones 19*a*, 19*b*, and 19*c*.

The spacing along the axis of cone 19*b* between heel row 23 and outermost inner row 29 is quite large, approximately equal to the widths of two rows 23. The spacing between heel row 23 and outermost inner row 29 of cone 19*c* is smaller, being approximately equal to the width of heel row 23. The spacing on cone 19*a* is even smaller between rows 23, 29. In some embodiments rows 23,29 overlap. The close spacing on cone 19*a* causes the inserts of rows 23, 29 to experience "balling" or "balling-up" of cuttings between them. Balling also tends to occur between the heel row 23 and the outermost inner row 29 of cones 19*b* and 19*c* and on other places on cones 19. This impedes the progress of the bit during drilling by preventing the cutting elements from penetrating completely to the earth. This causes the rate of penetration to fall substantially.

Figure 3:
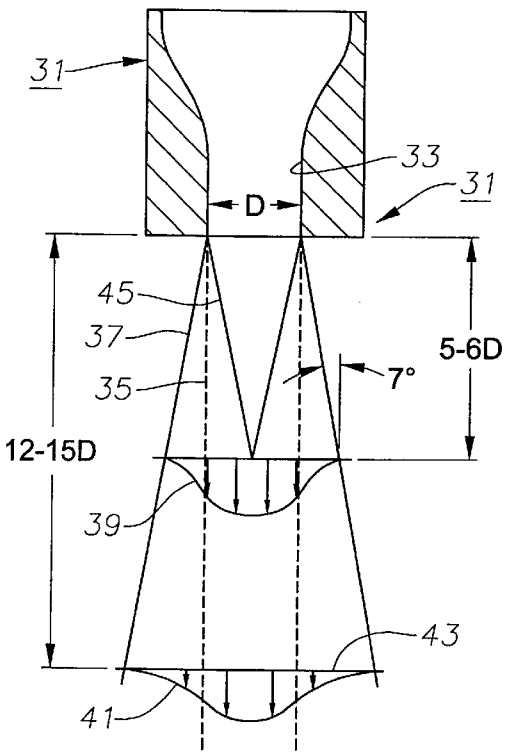
FIG. 3 is a schematic view of one of the nozzles of the earth-boring bit of FIG. 1.

Referring still to FIG. 2, bit 11 has three nozzles 31*a*, 31*b* and 31*c*, each associated with one of the legs 17*a*, 17*b* and 17*c*. Body 13 is hollow and has passages that lead to nozzles 31*a*, 31*b*, 31*c* (also referred to as nozzles 31) for discharging drilling fluid. Nozzles 31*a*, 31*b*, 31*c* are spaced approximately 120 degrees apart from each other relative to the bit axis of rotation. Each nozzle 31 is located between two of the cones 19. Referring to FIG. 3, each nozzle 31 has an orifice 33 of a selected minimum diameter D. Each nozzle 31 is a converging nozzle, rather than a diffusing nozzle. In a diffusing nozzle, the outlet portion diverges from a smaller diameter portion within the orifice. In this embodiment, the flow area at the outlet will not be any larger than the flow area at any point along orifice 33. Fluid discharges from orifice 33 in a diverging pattern, which consists of a conical converging region 45 and a surrounding skirt 37 of lower velocity. The velocity profile varies with the distance from the end of nozzle 31. Cylindrical core 35 is considered herein to be an imaginary projection from nozzle 31 having a diameter equal to the diameter of orifice 33.

Two velocity profiles 39, 41 are shown in FIG. 3. Fluid exits each nozzle 31 at a high velocity and entrains and accelerates the surrounding fluid at its boundary or skirt 37. As more fluid is entrained with increasing distance from the nozzle exit, the jet diameter increases to define the boundary of skirt 37. The angle of spread is typically seven degrees.

Figure 5:
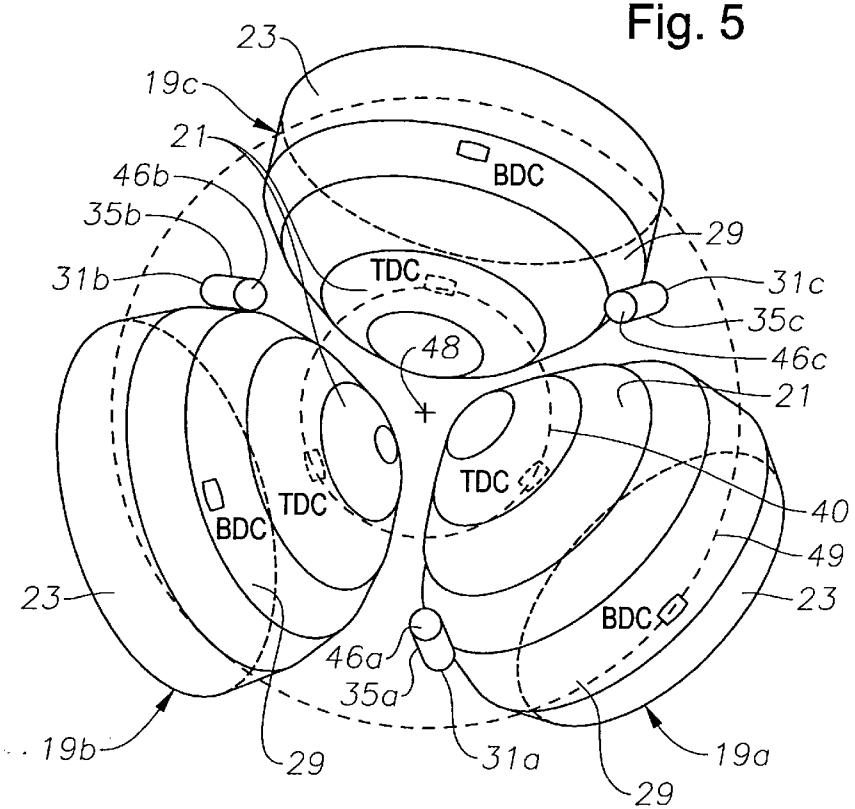
FIG. 5 is a schematic bottom view of the bit of FIG. 1, illustrating top and bottom dead centers and nozzle placement.

Referring to FIG. 5, the outlet of each nozzle 31 is located much closer to a trailing side of one of the cones 19 than a leading side of the adjacent cone. Furthermore, the outlet of each nozzle 31 is located at a minimum radial distance outward of bit axis 48. This minimum radial distance from axis 48 to the outlet of each nozzle 31 is preferably greater than or equal to distance 40 (indicated by the dashed line circle) from bit axis 48 to the top dead center (TDC) of the heel row 23 of any of the cones 19, and particularly the closest one to the particular nozzle 31. The top dead center refers to the highest point that any cutting element on heel row 23 will reach as it rotates around the bearing pin. The TDC distance 40 is measured from an axis of the most inward cutting element in heel row 23 of any of the cones to bit axis 48. The TDC distance 40 for each of the cones 19 is closer to bit axis 48 than the outlets of nozzles 33. In the embodiment shown, the TDC of the heel row 23 for each of the cones 19 is located the same distance 40 from bit axis 48 as the others.

Each nozzle 31*a*, 31*b*, 31*c* is positioned to direct a projected cylindrical core 35*a*, 35*b*, 35*c* (also referred to as cores 35) obliquely through heel row 23 and outermost inner row 29 on the trailing side of one of the cones 19. Each cylindrical core 35 contacts the borehole bottom significantly inward from bore sidewall 44. The numerals 46*a*, 46*b*, and 46*c* (also referred to as contact points 46) in FIGS. 2 and 5 indicate respectively the approximate points where cores 35*a*, 35*b*, 35*c* from nozzles 31*a*, 31*b*, and 31*c* strike the borehole bottom. Each contact point 46 is radially outward from bit axis 48 a distance that is less than 85% of the radius of bit 11 and in the preferred embodiment in the range from 55 to 80% of the radius of bit 11. Contact points 46 are thus radially inward from bore sidewall 44 (FIG. 2) a significant amount. Also, in this embodiment, nozzles 31 are parallel to bit axis 48 or inclined slightly inward toward bit axis 48, resulting in borehole bottom contact points 46 being lightly closer to bit axis 48 than the outlets of nozzles 31. In other embodiments, contacts 46 may be slightly farther from bit axis 48 than the outlets of nozzles 31.

Further, each contact point 46 is closer to bit axis 48 than the bottom dead center of the heel row 23 of any of the cones 19. The bottom dead center is the lowest point that any cutting element of heel row 23 will reach as it rotates about bearing pin axis 20 (FIG. 1). Furthermore, in the preferred embodiment, each contact point 46 is located closer than the bottom dead center of the farthest outermost inner row 29 of all of the cones 19. The bottom dead center (BDC) is shown in FIG. 5 for the outermost inner row 29 of each cone 19. The farthest outward row of the inner rows 29 of all of the cones 19 is located on cone 19*a*. Contact point 46*a* is considerably closer to bit axis 48 than the BDC of outermost inner row 29 of cone 19*a*. Contact point 46*b* is slightly closer to bit axis 48 than the BDC for of outermost inner row 29 of cone 19*b*, and considerably closer than the outermost inner row 29 of cone 19*a*, which is the farthest. Contact point 46*c* is significantly closer than the BDC of outermost inner row 29 of cone 19*c* and considerably closer to bit axis 48 than the BDC of outermost inner row 29 of cone 19*a*. The dashed line circle 49 in FIG. 5 indicates the maximum contact point distance from bit axis 48 for any of the contact points 46, which in this embodiment is the distance from the BDC of cone 19*a*, measured from a centerline or axis of one of the cutting elements in row 29 of cone 19*a*. In this embodiment, all three contact points 46*a*, 46*b*, 46*c* are located the same distance from bit axis 48, although they need not be.

Figure 4:
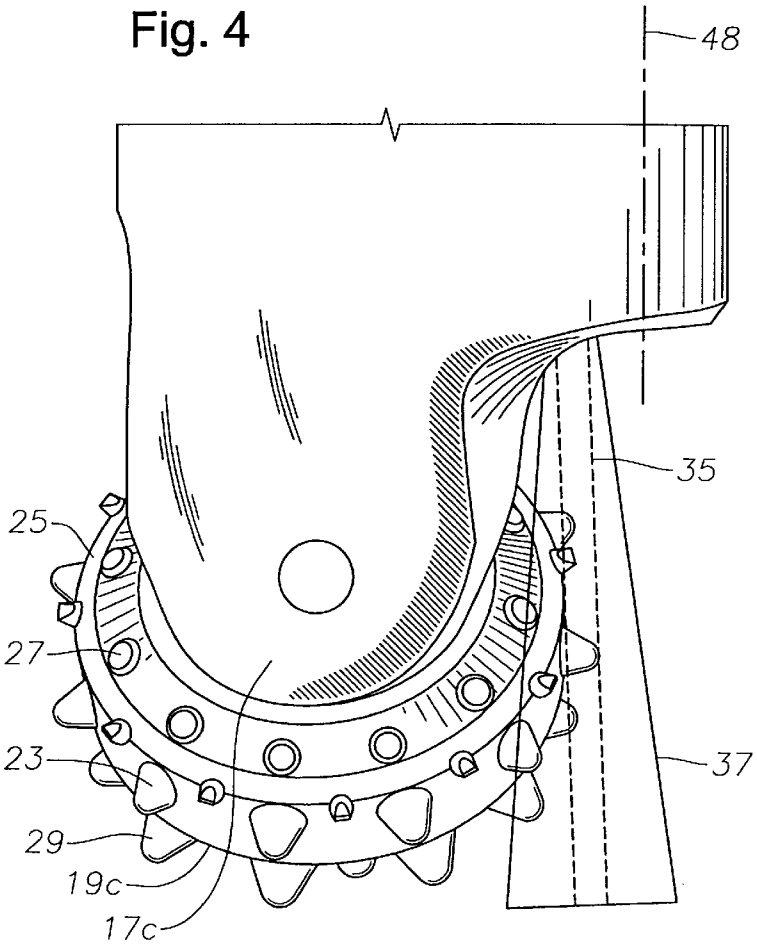
FIG. 4 is a side elevational view of a one of the bit legs and cone of the bit of FIG. 1, shown from another side.

Referring again to FIG. 1, cylindrical core 35 for nozzle 31*c* is shown. In this side view of cone 19*c*, cone axis 20 of cone 19*c* is located in a plane perpendicular with the viewing angle. At this viewing angle, cylindrical core 35 appears to be approximately parallel to bit axis 48. Referring to FIG. 4, only one of the thirds of body 13 is shown, which is shown to be the portion containing bit leg 17*c*. When viewing the backface of cone 19*c* as in FIG. 4, cylindrical core 35 of nozzle 31*c*, is shown directed generally downward. In this embodiment, cylindrical core 35 is generally tangent to a point on the surface of cone 19*c* and passes obliquely through heel row 23 and outermost inner row 29. This orientation is the same for each of the nozzles 31. The orientation results in jet cylindrical core 35 contacting the borehole bottom 43 (FIG. 3) at points 46*a*, 46*b*, and 46*c* (FIGS. 2 and 5) after passing through heel row 23 and outermost inner row 29. Cylindrical core 35 does not contact the borehole wall or corner with the wall.

Figure 6:
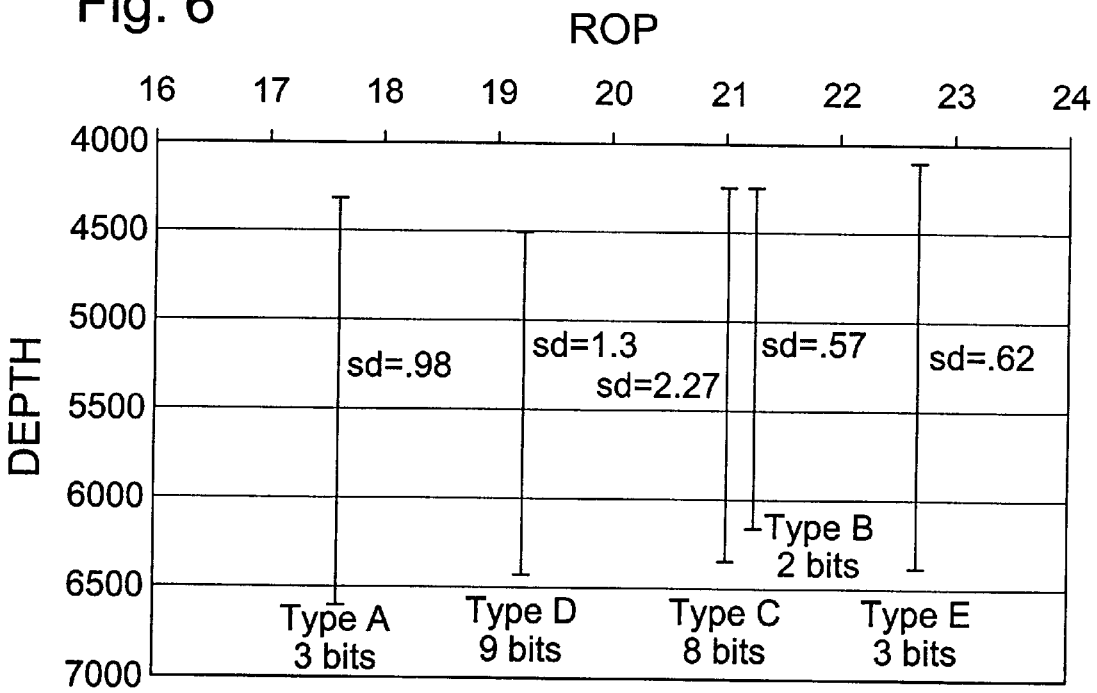
FIG. 6 is a graph illustrating field performance of bits constructed in accordance with this invention compared to prior art type bits.

Referring to FIG. 6, bits constructed in accordance with this invention, indicated as type E, were tested under actual drilling conditions in the field and compared to four prior art type bits, referred to as types A–D. The bits with the five different nozzle orientations were run under similar drilling practices by one drilling contractor working for one operator in a localized area. The bits listed in FIG. 6 were run in Panola County, Tex. Twenty-one bits were selected for comparison. The bits drilled about 2000 feet of sandstone/shale mixture before dulling out in the top of the Travis Peak. All were run on rotary assemblies at 70–80 rpm with 40–45 KIPS and 6–7.5 HSI with about 10.7 ppg mud. In FIG. 6, the horizontal axis represents rate of penetration in feet per hour and the vertical axis represents depth. The average of several bit runs is shown as a vertical bar on this figure. The position of the bar from left to right indicates the average rate of penetration of the bit. The ends of the bar represent the average depth in and depth out for the bits. The type of bit, the number of bits and standard deviation of the average are shown below each bar.

The five bit types were similar except for the nozzle orientations. The type A bits had nozzles with cylindrical discharge cores passing approximately equidistant between leading and trailing sides of the cones and generally toward the gage. The type B bits had nozzles with cylindrical discharge cores inclined toward and generally tangent to the leading edge of the nearest cone and pointed toward the gage. The type C bits had nozzles similar to type B, but with cylindrical discharge cores inclined further outward toward the borehole wall and also generally tangent to a leading side of the nearest cone. The type D bits had nozzles with cylindrical discharge cores inclined toward the trailing side of the nearest cone and toward the gage surface. The type E bits had cylindrical discharge cores oriented in accordance with this invention.

The graph of FIG. 6 shows that the type E bits drill faster than all the other types. The average rate of penetration ("ROP") is about 22.7 feet per hour. Considering the averages and standard deviations, the average ROP of the type C and type E bits are the two which are most likely to be similar. The difference between the type E and type C bits is statistically significant to a confidence level of 97%. The ranking of ROP for the five different bit types corresponds relatively well with that predicted laboratory tests.

The invention has significant advantages. The test data, both in the laboratory and the field, indicates that bits with nozzle orientations in accordance with this invention have greater rates of penetration than prior art orientations under similar conditions. Furthermore, the bits in accordance with this invention have better abilities to clean both the cone and the borehole and to evacuate cuttings from under the bit. Additional tests have determined that cone erosion has not been a life-limiting factor in bits with nozzles oriented in accordance with the invention.

While the invention has been shown in only one of its forms, it should be apparent to those skilled in the art that it is not so limited but is susceptible to various changes without departing from the scope of the invention. For example, although each nozzle has of the preferred embodiment is oriented in accordance with this invention, it may not be necessary to orient all of them accordingly. Additionally, the inner cutting elements need not be in rows, rather could be randomly spaced.

We claim:

1. In an earth-boring bit having a body with a bit axis, a plurality of bit legs depending from the body, a cone rotatably mounted to each of the bit legs, each of the cones having a heel row of cutting elements adjacent a gage surface and a plurality of inner cutting elements, the improvement comprising:

at least one nozzle mounted to the body, the nozzle having an outlet located radially outward from the bit axis a distance that is at least equal to a distance from a top dead center of the heel row of any one of the cones to the bit axis; and the nozzle being oriented to discharge drilling fluid along a line that passes between two of the cones closer to a trailing side of one of the cones than a leading side of the other of the cones and positioned to contact a borehole bottom at a distance from the bit axis that is no greater than a distance from the bit axis to a bottom dead center of the heel row of any one of the cones.

2. The earth-boring bit of claim 1, wherein the line along which the nozzle discharges drilling fluid is positioned to contact the borehole bottom at a distance from the bit axis that is no greater than a distance from the bit axis to a bottom dead center of a farthest outermost inner cutting element of all of the cones.

3. The earth-boring bit of claim 1, wherein the nozzle has a discharge pattern with a projected cylindrical core that is substantially tangent to a trailing side of one of the cones.

4. The earth-boring bit of claim 1, wherein the distance that the outlet of the nozzle is located from the bit axis is at least equal to the distance from the bit axis to where the line of the nozzle is positioned to contact the borehole bottom.

5. The earth-boring bit of claim 1, wherein the line along which the nozzle discharges is positioned to contact the borehole bottom at a point located outward from the bit axis a distance that is no greater than about 85 percent of a radius of the bit.

6. The earth-boring bit of claim 1, wherein the line along which the nozzle discharges is positioned to contact the borehole bottom at a point outward from the bit axis that is in the range from 55 to 80% of a radius of the bit.

7. In an earth-boring bit having a body with a bit axis, a plurality of bit legs depending from the body, a cone rotatably mounted to each of the bit legs, each of the cones having a heel row of cutting elements adjacent a gage surface and a plurality of inner cutting elements, the improvement comprising:

at least one nozzle mounted to the body, the nozzle having an outlet located radially outward from the bit axis a distance that is at least equal to a distance from a top dead center of the heel row of any one of the cones to the bit axis;

the nozzle being oriented to discharge drilling fluid along a line that is positioned to contact a borehole bottom at a contact point distance from the bit axis that is no greater than a distance from the bit axis to a bottom dead center of a farthest outermost inner cutting element of all of the cones; and wherein the line along which the nozzle discharges drilling fluid passes between adjacent ones of the cones and is located closer to one of the cones than to the other cone of said adjacent ones of the cones.

8. In an earth-boring bit having a body with a bit axis, a plurality of bit legs depending from the body, a cone rotatably mounted to each of the bit legs, each of the cones having a heel row of cutting elements adjacent a gage surface and a plurality of inner cutting elements, the improvement comprising:

at least one nozzle mounted to the body, the nozzle having an outlet located radially outward from the bit axis a distance that is at least equal to a distance from a top dead center of the heel row of any one of the cones to the bit axis;

the nozzle being oriented to discharge drilling fluid along a line that is positioned to contact a borehole bottom at a contact point distance from the bit axis that is no greater than a distance from the bit axis to a bottom dead center of a farthest outermost inner cutting element of all of the cones; and wherein the line along which the nozzle discharges drilling fluid passes between adjacent ones of the cones and is located closer to a trailing side of one of the cones than a leading side of the other cone of said adjacent ones of the cones.

9. The earth-boring bit of claim 8, wherein the nozzle has a discharge pattern with a projected cylindrical core that is substantially tangent to the trailing side of said one of the cones.

10. The earth-boring bit of claim 8, wherein the distance that the outlet of the nozzle is located from the bit axis is at least equal to the contact point distance.

11. The earth-boring bit of claim 8, wherein the contact point distance is no greater than about 85 percent of a radius of the bit.

12. The earth-boring bit of claim 8, wherein the contact point distance is in the range from 55 to 80% of a radius of the bit.

13. In an earth-boring bit having a body with a bit axis, a plurality of bit legs depending from the body, a cone rotatably mounted to each of the bit legs, each of the cones having a heel row of cutting elements adjacent a gage surface and a plurality of inner cutting elements, the improvement comprising:

at least one nozzle mounted to the body, the nozzle having an outlet located radially outward from the bit axis a distance that is at least equal to a distance from a top dead center of the heel row of any one of the cones to the bit axis; and wherein the nozzle is oriented to discharge fluid along a line that is positioned to contact the borehole bottom at a point located outward from the bit axis a contact point distance that is no greater than about 85 percent of a radius of the bit; and wherein the line along which the nozzle discharges drilling fluid passes between adjacent ones of the cones and is located closer to one of the cones than to the other cone of said adjacent ones of the cones.

14. In an earth-boring bit having a body with a bit axis, a plurality of bit legs depending from the body, a cone rotatably mounted to each of the bit legs, each of the cones having a heel row of cutting elements adjacent a gage surface and a plurality of inner cutting elements, the improvement comprising:

at least one nozzle mounted to the body, the nozzle having an outlet located radially outward from the bit axis a distance that is at least equal to a distance from a top dead center of the heel row of any one of the cones to the bit axis;

wherein the nozzle is oriented to discharge fluid along a line that is positioned to contact the borehole bottom at a point located outward from the bit axis a contact point distance that is no greater than about 85 percent of a radius of the bit; and wherein the line along which the nozzle discharges passes between adjacent ones of the cones and is located closer to a trailing side of one of the cones than a leading side of the other cone of said adjacent ones of the cones.

15. The earth-boring bit of claim 14, wherein the contact point distance is in the range from 55 to 80% of the radius of the bit.

16. The earth-boring bit of claim 14, wherein the nozzle has a discharge pattern with a projected cylindrical core, the core passing obliquely between a farthest outermost inner cutting element and the heel row substantially tangent to the trailing side of said one of the cones.

17. The earth-boring bit of claim 14, wherein the distance that the nozzle outlet is located from the bit axis is at least equal to the contact point distance.

18. The earth-boring bit of claim 14, wherein the contact point distance is no greater than a distance from a bottom dead center of a farthest outermost inner cutting element of all of the cones to the bit axis.

19. An earth-boring bit, comprising:

a body having an axis;

a plurality of bit legs depending from the body, each having a depending bearing pin;

a cone rotatably mounted to each of the bearing pins, each of the cones having an exterior surface with cutting elements protruding therefrom, the cutting elements being arranged in a heel row of cutting elements and a plurality of inner rows of cutting elements, including an outermost inner row of cutting elements located between the heel row and the inner row; and at least one nozzle mounted to the body and positioned for discharging drilling fluid in a diverging pattern having a projected cylindrical core that passes obliquely between the heel row and the outermost inner row along a trailing side of one of the cones.

20. An earth-boring bit, comprising:

a body having an axis;

a plurality of bit legs depending from the body, each having a depending bearing pin;

a cone rotatably mounted to each of the bearing pins, each of the cones having an exterior surface with cutting elements protruding therefrom, the cutting elements being arranged in a heel row of cutting elements and a plurality of inner rows of cutting elements, including an outermost inner row of cutting elements located between the heel row and the inner row;

at least one nozzle mounted to the body and positioned for discharging drilling fluid in a diverging pattern having a projected cylindrical core that passes obliquely between the heel row and the outermost inner row along a trailing side of one of the cones; and wherein the nozzle has an outlet located radially outward from the bit axis a distance that is at least equal to a distance from a top dead center of the heel row of each of the cones to the bit axis.

21. The earth-boring bit according to claim 20, wherein the core of the nozzle is positioned to contact a borehole bottom at a point located outward from the bit axis a contact point distance that is no greater than a distance from a bottom dead center of a farthest outermost inner row of all of the cones to the bit axis.

22. The earth-boring bit according to claim 20, wherein the core of the nozzle is positioned to contact a borehole bottom at a point located outward from the bit axis a contact point distance that is less than 85 percent of a radius of the bit.

23. The earth-boring bit according to claim 22, wherein the contact point distance is in the range from 55 to 80 percent of the radius of the bit.

24. An earth-boring bit, comprising:

a body having an axis;

a plurality of bit legs depending from the body, each having a depending bearing pin;

a cone rotatably mounted to each of the bearing pins, each of the cones having an exterior surface with cutting elements protruding therefrom, the cutting elements being arranged in a heel row of cutting elements and a plurality of inner rows of cutting elements, including an outermost inner row of cutting elements located between the heel row and the inner row;

at least one nozzle mounted to the body and positioned for discharging drilling fluid in a diverging pattern having a projected cylindrical core that passes obliquely between the heel row and the outermost inner row along a trailing side of one of the cones;

wherein the nozzle has an outlet located radially outward from the bit axis a distance that is at least equal to a distance from a top dead center of the heel row of each of the cones to the bit axis; and wherein the core of the nozzle is adapted to contact a borehole bottom at a contact point distance from the bit axis that is no greater than a distance from a bottom dead center of the farthest outermost inner row to the bit axis.

25. An earth-boring bit, comprising:

a body having a bit axis;

a plurality of bit legs depending from the body;

a cone rotatably mounted to each of the bit legs, each of the cones having a heel row of cutting elements adjacent a gage surface and a plurality of inner rows of cutting elements;

at least one nozzle having an outlet located radially outward from the bit axis a distance that is at least equal to a distance from a top dead center of the heel row of any of the cones to the bit axis; and the nozzle having a projected cylindrical core of drilling fluid that is positioned to pass between two of the cones closer to a trailing side of one of the cones than a leading side of the other cone, the nozzle being oriented to cause the core to contact a borehole bottom at a contact point distance from the bit axis that is no greater than a distance from a bottom dead center of farthest outermost inner row of all of the cones to the bit axis, said contact point distance being no greater than 85% of a radius of the bit.

26. The earth-boring bit of claim 25, wherein the contact point distance is in the range from 55 to 80% of the radius of the bit.

* * * * *

UNITED STATES PATENT AND TRADEMARK OFFICE

CERTIFICATE OF CORRECTION

PATENT NO. : 6,354,387 B1
DATED : March 12, 2002
INVENTOR(S) : Thomas M. Harris et al.

It is certified that error appears in the above-identified patent and that said Letters Patent is hereby corrected as shown below:

Column 4,
Line 15, delete “head row or”

Column 5,
Line 14, delete “portion” and insert therefor -- portions --

Column 6,
Line 53, delete “lightly” and insert therefor -- slightly --

Column 8,
Line 9, insert -- in -- before “laboratory”

Signed and Sealed this

Second Day of July, 2002

*Attest:*

*Attesting Officer*

JAMES E. ROGAN
*Director of the United States Patent and Trademark Office*